US009534770B2

(12) United States Patent
Lin

(10) Patent No.: US 9,534,770 B2
(45) Date of Patent: Jan. 3, 2017

(54) ANTI-SHOCK LAMP SOCKET

(71) Applicant: Po-Heng Lin, New Taipei (TW)

(72) Inventor: Po-Heng Lin, New Taipei (TW)

( * ) Notice: Subject to any disclaimer, the term of this patent is extended or adjusted under 35 U.S.C. 154(b) by 148 days.

(21) Appl. No.: 14/622,596

(22) Filed: Feb. 13, 2015

(65) Prior Publication Data

US 2016/0186963 A1 Jun. 30, 2016

(30) Foreign Application Priority Data

Dec. 30, 2014 (TW) ..... 103223268 U

(51) Int. Cl.

| | |
|---|---|
| ***F21V 21/30*** | (2006.01) |
| ***F21V 15/04*** | (2006.01) |
| ***F21V 21/00*** | (2006.01) |
| ***F21V 15/01*** | (2006.01) |
| *F21V 29/76* | (2015.01) |

(52) U.S. Cl.

CPC ..... *F21V 21/30* (2013.01); *F21S 4/20* (2016.01); *F21S 4/22* (2016.01); *F21V 15/013* (2013.01); *F21V 15/04* (2013.01); *F21V 21/00* (2013.01); *F21V 29/763* (2015.01)

(58) Field of Classification Search

CPC ..... F21V 15/04; F21V 21/30; F21V 15/013; F21S 4/20; F21S 4/22

USPC ..... 362/655, 249.03

See application file for complete search history.

(56) References Cited

U.S. PATENT DOCUMENTS

| | | | | | |
|---|---|---|---|---|---|
| 3,177,356 | A * | 4/1965 | Worden | F21S 48/31 | 362/374 |
| 3,601,595 | A * | 8/1971 | Kivela | F21L 4/04 | 362/190 |
| 4,056,718 | A * | 11/1977 | Faux, Sr. | F21V 15/04 | 362/306 |
| 4,150,422 | A * | 4/1979 | Peralta | F21V 15/04 | 362/218 |
| 4,198,027 | A * | 4/1980 | Urbanek | F21V 15/04 | 248/634 |
| 4,317,625 | A * | 3/1982 | Van Allen | G03B 15/05 | 362/16 |

(Continued)

FOREIGN PATENT DOCUMENTS

| | | | | |
|---|---|---|---|---|
| KR | WO 2014115904 | A1 * | 7/2014 | F21V 21/14 |
| KR | EP 2811225 | A1 * | 12/2014 | F21V 31/005 |

*Primary Examiner* — Eret McNichols

(74) *Attorney, Agent, or Firm* — Ming Chow; Sinorica, LLC

(57) ABSTRACT

A simple anti-shock lamp socket has a support plate, a damping sheet, and a first locking component. The support plate has a positioning hole and two extending sheets. The extending sheets are respectively formed on and protrude from two ends of the support plate. The damping sheet is mounted under the support plate and has a connection hole. The first locking component is mounted through the positioning hole and the connection hole. The retaining stand has a bearing plate, a flexible plate, and a second locking component. The bearing plate has a locking portion and a fastening portion. The locking portion is mounted between the extending sheets. The fastening portion is formed on the bearing plate. The flexible plate is mounted on the bearing plate and is mounted around the fastening portion. The second locking component is mounted through the extending sheets and the locking portion.

8 Claims, 4 Drawing Sheets

(56) References Cited

U.S. PATENT DOCUMENTS 4,379,322 A * 4/1983 Kelly ..... F21S 8/086 362/300
4,423,471 A * 12/1983 Gordin ..... F21V 15/04 362/218
6,299,326 B1 * 10/2001 Andrus ..... F21S 2/00 362/217.12
7,527,393 B2 * 5/2009 Gordin ..... F21V 15/04 362/158
7,600,907 B2 * 10/2009 Liu ..... F21V 19/001 362/249.03
7,950,821 B1 * 5/2011 Georgitsis ..... B60Q 1/0483 362/217.12
D648,478 S * 11/2011 Yu ..... D26/118
8,142,047 B2 * 3/2012 Acampora ..... F21V 3/00 362/217.01
8,277,077 B2 * 10/2012 Georgitsis ..... B60Q 1/0483 362/217.12
8,287,144 B2 * 10/2012 Pedersen ..... F21S 10/02 362/217.01
8,439,522 B2 * 5/2013 Kim ..... F21V 21/30 362/249.03
D717,479 S * 11/2014 Sievers ..... D26/31
8,926,126 B2 * 1/2015 Ronen ..... F21V 15/013 362/225
8,974,102 B2 * 3/2015 Paine ..... B60Q 1/0088 362/235
D729,677 S * 5/2015 Aho ..... D10/114.4
2004/0257805 A1 * 12/2004 Lee ..... F16M 11/02 362/655
2005/0111223 A1 * 5/2005 Lee ..... F21L 14/00 362/269
2013/0250556 A1 * 9/2013 Gordin ..... F21S 8/088 362/147
2016/0076733 A1 * 3/2016 Eustace ..... F21V 7/0033 362/247
2016/0102815 A1 * 4/2016 Bailey ..... F21V 21/30 362/477
2016/0169475 A1 * 6/2016 Kliegl ..... F21V 5/008 362/268

* cited by examiner

ANTI-SHOCK LAMP SOCKET

The current application claims a foreign priority to the patent application of Taiwan No. 103223268 filed on Dec. 30, 2014.

BACKGROUND OF THE INVENTION

1. Field of the Invention

The present invention is a lamp socket, especially an anti-shock lamp socket that can be easily combined with an illumination lamp.

2. Description of the Prior Arts

A lamp is a lighting device that emits particular types of light, and the lamp is widely developed for various applications such as a daylight lamp mounted in the indoor space, a road lamp mounted on an outdoor street/road, or a searching lamp mounted on a vehicle. Each type of lamp is installed in a specific way. The daylight lamp and the road lamp are stationary lamps. The searching lamp is portable for convenience. Therefore, the searching lamp has a connecting stand connected to a vehicle, and the searching lamp is securely mounted on the vehicle by the connecting stand. However, the conventional connecting stand and the searching lamp are difficult to disassemble due to the complicated connecting structure. After disassembly, the conventional connecting stand and the conventional searching lamp are not easy to store due to the large volume. In addition, the conventional connecting stand cannot provide an anti-shock effect to the conventional searching lamp, so the conventional searching lamp might be damaged by vibration after a long time of use.

To overcome the shortcomings, the present invention provides an anti-shock lamp socket to mitigate or obviate the aforementioned problems.

SUMMARY OF THE INVENTION

The main objective of the present invention is to provide an anti-shock lamp socket that provides ease of disassembling and is shockproof.

The anti-shock lamp socket comprises a bracket and a retaining stand. The bracket has a support plate, a damping sheet and a first locking component. The support plate has a positioning hole and two extending sheets. The positioning hole is formed through a top surface and a bottom surface of the support plate at a middle of the support plate. The two extending sheets are respectively formed on and protrude from two ends of the support plate. The damping sheet is mounted on the bottom surface of the support plate and has a connection hole, and the connection hole communicates with the positioning hole of the support plate. The first locking component is mounted through the positioning hole and the connection hole.

The retaining stand is mounted on the bracket and has a bearing plate, a flexible plate, and a second locking component. The bearing plate is an inward-curved arc and has a locking portion and a fastening portion. The locking portion is transversally formed on and protrudes from a bottom surface of the bearing plate and is mounted between the two extending sheets of the support plate. The fastening portion is formed on one end of the bearing plate and is distal from the locking portion. The flexible plate is mounted on the bearing plate and is sleeved around the fastening portion. The second locking component is mounted through the extending sheets and the locking portion for locking the support plate and the bearing plate.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
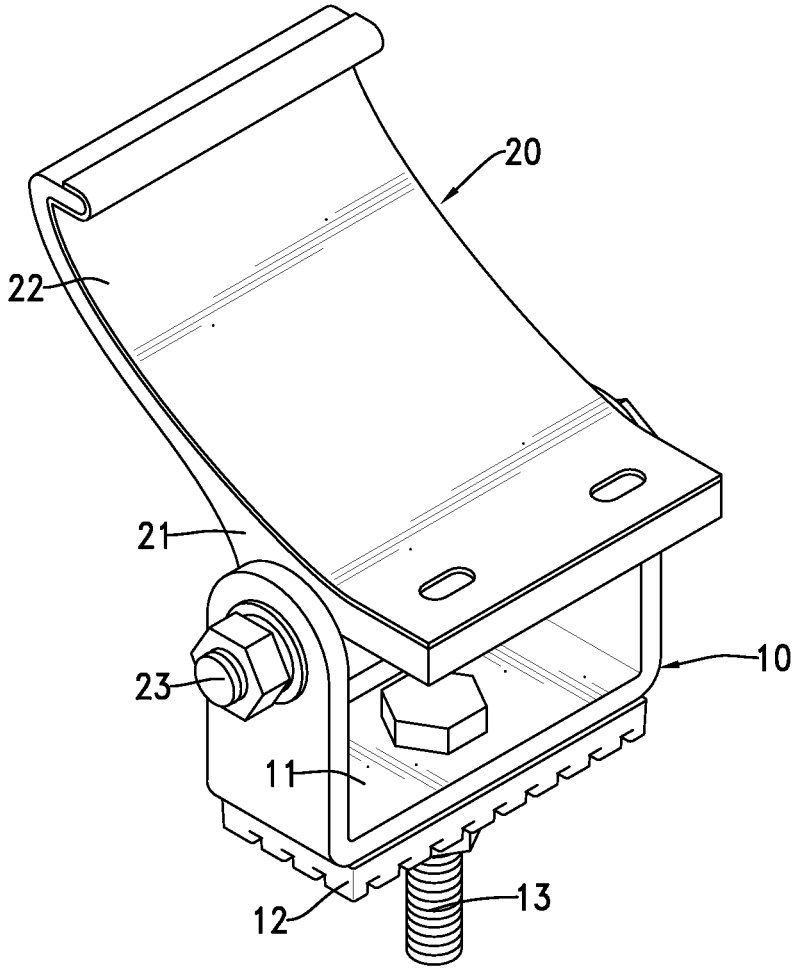
FIG. 1 is a perspective view of an anti-shock lamp socket in accordance with the present invention.
Figure 2:
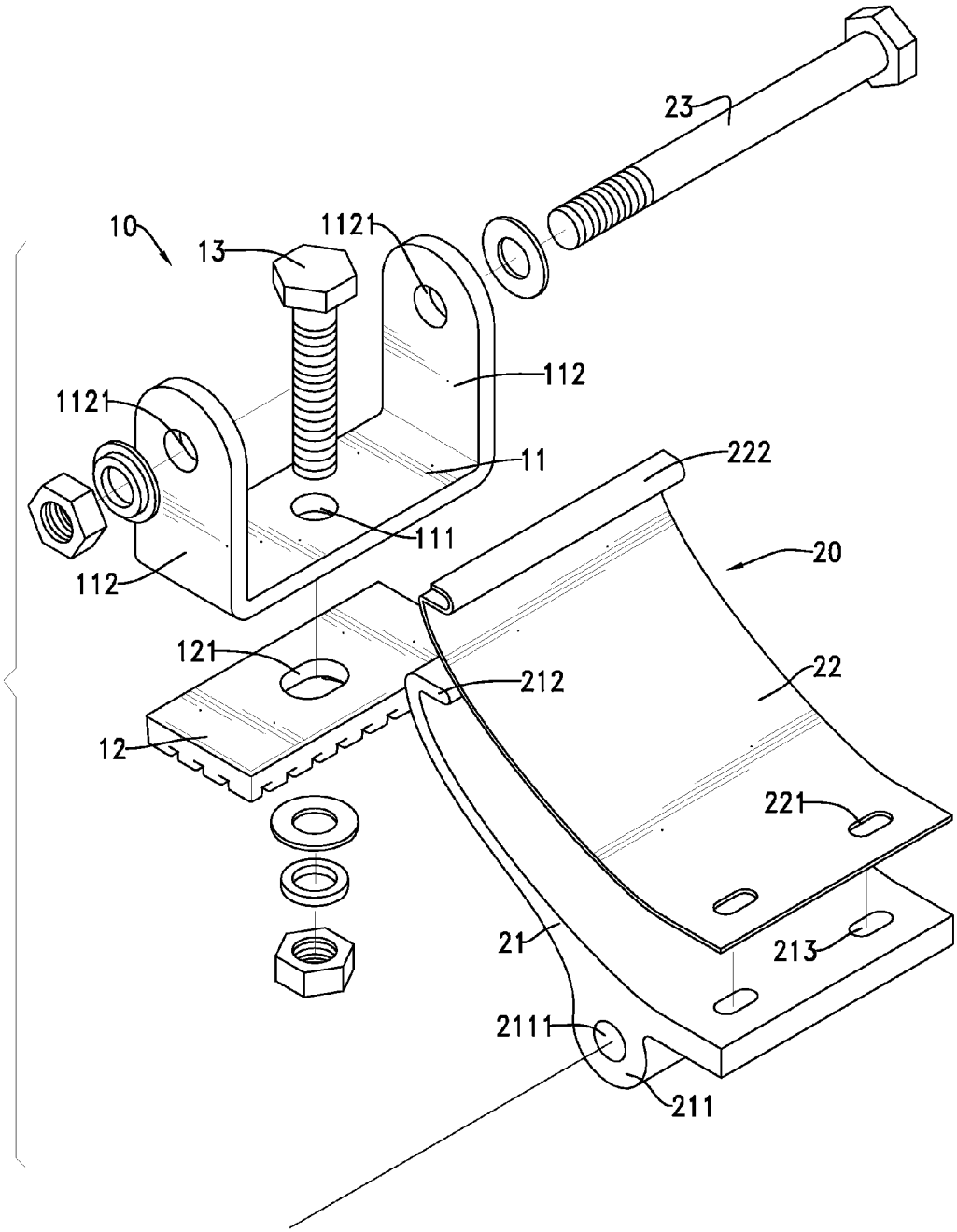
FIG. 2 is an exploded perspective view of the anti-shock lamp socket in FIG. 1.
Figure 3:
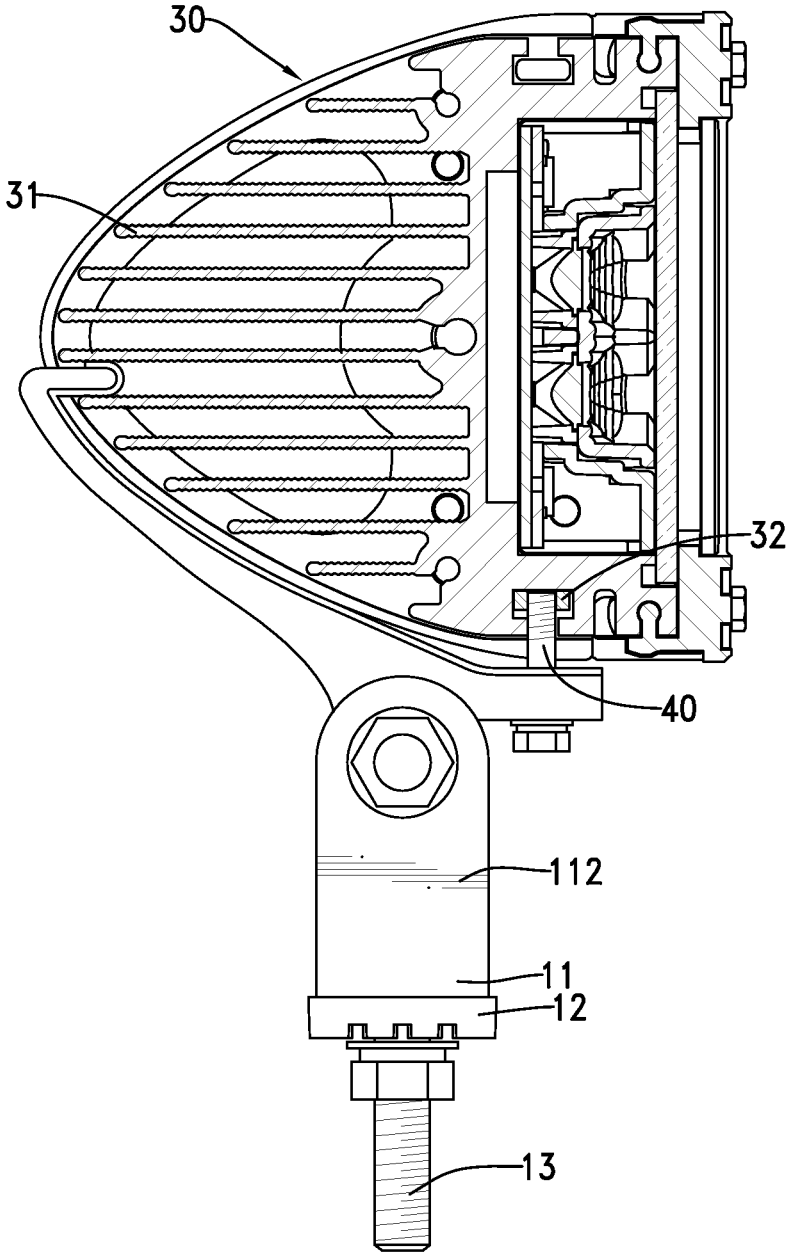
FIG. 3 is a partially cross-sectional side view of an illumination lamp combined with the anti-shock lamp socket in FIG. 1.
Figure 4:
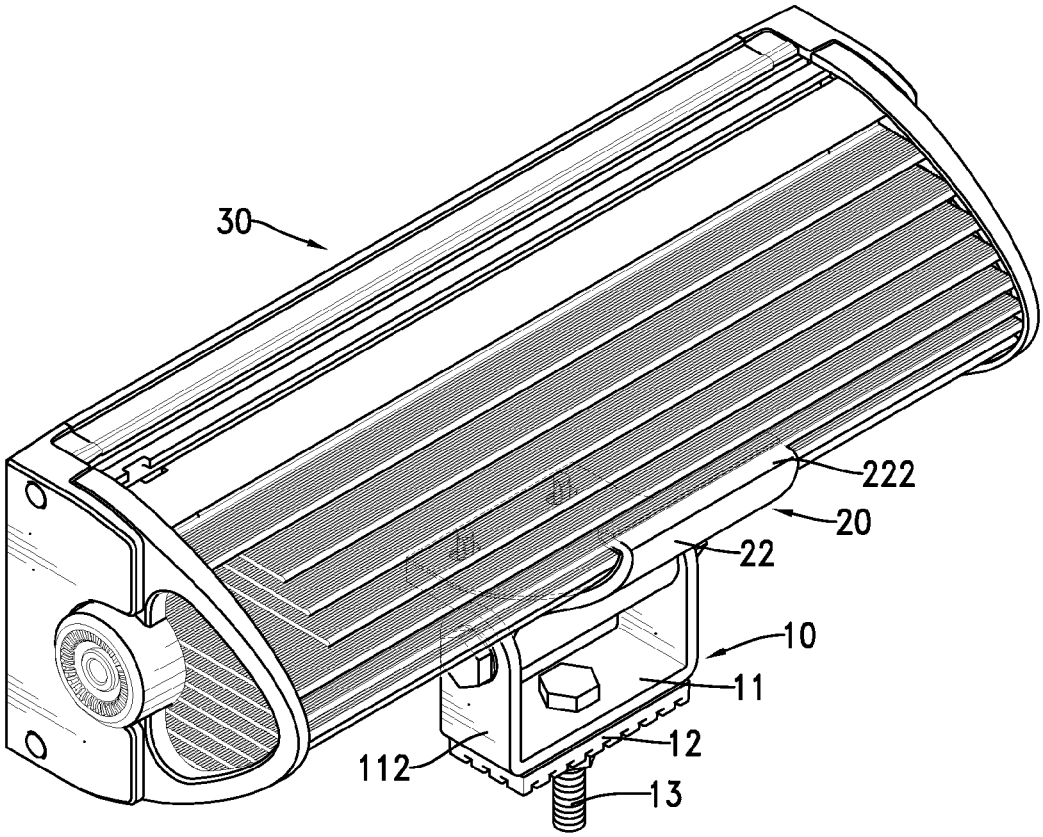
FIG. 4 is a perspective view of the illumination lamp combined with the anti-shock lamp socket in FIG. 3.

With reference to FIGS. 1 and 2, an anti-shock lamp socket in accordance with the present invention comprises a bracket 10 and a retaining stand 20.

The bracket 10 has a support plate 11, a damping sheet 12 and a first locking component 13. The support plate 11 is a U-shaped plate and has a positioning hole 111 and two extending sheets 112. The positioning hole 111 is formed through a top surface and a bottom surface of the support plate 11 at a middle of the support plate 11. The extending sheets 112 are respectively formed on and protrude from two opposite ends of the support plate 11 beside the positioning hole 111. Each extending sheet 112 has a clamping hole 1121 formed through the extending sheet 112, and the clamping holes 1121 of the extending sheets 112 are disposed in alignment with each other.

The damping sheet 12 is made of elastic material and is mounted on the bottom surface of the support plate 11. The damping sheet 12 has a connection hole 121, and the connection hole 121 is formed through the damping sheet 12 and communicates with the positioning hole 111 of the support plate 11. The first locking component 13 is mounted through the positioning hole 111 and the connection hole 121. A nut is screwed with the first locking component 13 to tighten the damping sheet 12 with the support plate 11.

The retaining stand 20 is mounted on the bracket 10 and has a bearing plate 21, a flexible plate 22, and a second locking component 23. The bearing plate 21 is in an inward-curved arc and has a locking portion 211, a fastening portion 212, and two first connecting holes 213. The locking portion 211 is transversally formed on and protrudes from a bottom surface of the bearing plate 21 and is mounted between the extending sheets 112 of the support plate 11. The locking portion 211 has a lock hole 2111 formed through two ends of the locking portion 211, and the lock hole 2111 is disposed in alignment with the clamping holes 1121 of the extending sheets 112. The fastening portion 212 is formed on a top end of the bearing plate 21 and is distal from the locking portion 211. In a preferred embodiment, the fastening portion 212 is an elongated bar. The first connecting holes 213 are formed through a bottom end of the bearing plate 21 near the locking portion 211.

The flexible plate 22 is mounted on the bearing plate 21 and has two second connecting holes 221 and a bending portion 222. The flexible plate 22 is made of elastic material. The second connecting holes 221 are formed through a bottom end of the flexible plate 22 and respectively communicate with the first connecting holes 213. The bending portion 222 is formed on and protrudes from a top end of the flexible plate 22 and is distal from the second connecting holes 221. The bending portion 222 is mounted around the fastening portion 212, so the flexible plate 22 is attached on the bearing plate 21. The second locking component 23 is mounted through the clamping holes 1121 of the extending sheets 112 and the lock hole 2111 of the locking portion 211. A nut is screwed with the second locking component 23 to connect the bearing plate 21 with the support plate 11.

With reference to FIGS. 1 to 4, in use, the present invention is assembled with an illumination lamp 30. The illumination lamp 30 has multiple heat-dissipating fins 31 and multiple fixing holes 32. The heat-dissipating fins 31 are formed in various lengths, and are horizontally formed on and protrude from a rear surface of the illumination lamp 30. The heat-dissipating fins 31 are arranged with interval spaces from one another and are each formed in shape of an arc. The illumination lamp 30 is held by the flexible plate 22. The bending portion 222 and the fastening portion 212 are connected in the space between two adjacent heat-dissipating fins 31. The flexible plate 22 is mounted between the bearing plate 21 and the illumination lamp 30 to provide a shockproof effect. The fixing holes 32 are disposed below the illumination lamp 30 and communicate with the second connecting holes 221. Two third locking components 40 are respectively mounted through the first connecting holes 213 and the second connecting holes 221, and the third locking components 40 are screwed in the fixing holes 32 to tighten the illumination lamp 30 with the retaining stand 20. The shockproof effect of the flexible plate 22 can prevent damage of the illumination lamp 30 from colliding with the bearing plate 21 of the retaining stand 20. Furthermore, the bracket 10 can be positioned by the first locking component 13, and the illumination lamp 30 is connected with the retaining stand 20 by a simple way, so the present invention is easy to disassemble and store.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An anti-shock lamp socket comprising:

a bracket having a support plate having a positioning hole formed through a top surface and a bottom surface of the support plate at a middle of the support plate; and two extending sheets respectively formed on and protruding from two ends of the support plate;

a damping sheet mounted on the bottom surface of the support plate and having a connection hole communicating with the positioning hole of the support plate; and a first locking component mounted through the positioning hole and the connection hole;

a retaining stand mounted on the bracket and having a bearing plate being an inward-curved arc and having a locking portion transversally formed on and protruding from a bottom surface of the bearing plate and mounted between the two extending sheets of the support plate; and a fastening portion formed on one end of the bearing plate and being distal from the locking portion;

a flexible plate mounted on the bearing plate and sleeved around the fastening portion; and a second locking component mounted through the extending sheets and the locking portion for locking the support plate and the bearing plate.

2. The anti-shock lamp socket as claimed in claim 1, wherein the bearing plate has two first connecting holes, the first connecting holes are formed through a bottom end of the bearing plate near the locking portion; and the flexible plate has two second connecting holes and a bending portion, the second connecting holes are formed through a bottom end of the flexible plate and respectively communicating with the first connecting holes of the bearing plate, the bending portion is formed on and protrudes from a top end of the flexible plate and is distal from the second connecting holes, and the bending portion is mounted around the fastening portion.

3. The anti-shock lamp socket as claimed in claim 1, wherein the two extending sheets are located on two sides of the support plate beside the positioning hole, each extending sheet has a clamping hole formed through the extending sheet, and the clamping holes of the extending sheets are disposed in alignment with each other.

4. The anti-shock lamp socket as claimed in claim 2, wherein the two extending sheets and are located on two sides of the support plate beside the positioning hole, each extending sheet has a clamping hole formed through the extending sheet, and the clamping holes of the extending sheets are disposed in alignment with each other.

5. The anti-shock lamp socket as claimed in claim 3, wherein the locking portion has a lock hole formed through two ends of the locking portion, and the lock hole is disposed in alignment with the clamping holes of the extending sheets, the second locking component is mounted through the clamping holes and the lock hole, and a nut is screwed with the second locking component to connect the bearing plate with the support plate.

6. The anti-shock lamp socket as claimed in claim 4, wherein the locking portion has a lock hole formed through two ends of the locking portion, and the lock hole is disposed in alignment with the clamping holes of the extending sheets, the second locking component is mounted through the clamping holes and the lock hole, and a nut is screwed together with the second locking component to connect the bearing plate with the support plate.

7. The anti-shock lamp socket as claimed in claim 5, wherein the flexible plate is made of elastic material.

8. The anti-shock lamp socket as claimed in claim 6, wherein the flexible plate is made of elastic material.

* * * * *